US006212980B1

(12) United States Patent
Kratch et al.

(10) Patent No.: US 6,212,980 B1
(45) Date of Patent: Apr. 10, 2001

(54) SCREW ALIGNING AND GUIDING DEVICE HAVING ARRANGEMENT WHICH FACILITATES LOADING AND UNLOADING OF SCREW STRIP

(75) Inventors: Kevin H. Kratch, Louisville; Gregory A. Phillips, Lagrange, both of KY (US)

(73) Assignee: Vermont American Corporation, Louisville, KY (US)

( * ) Notice: Subject to any disclaimer, the term of this patent is extended or adjusted under 35 U.S.C. 154(b) by 0 days.

(21) Appl. No.: 09/373,140

(22) Filed: Aug. 12, 1999

(51) Int. Cl.[7] ..... B25B 23/06
(52) U.S. Cl. ..... 81/434; 81/57.36
(58) Field of Search ..... 81/434, 435, 57.36, 81/57.37

(56) References Cited

U.S. PATENT DOCUMENTS

| | | | | |
|---|---|---|---|---|
| D. 391,135 | | 2/1998 | Habermehl et al. . | |
| 1,815,594 | | 7/1931 | Shaw et al. . | |
| 2,445,674 | | 7/1948 | Kendall . | |
| 2,943,652 | * | 7/1960 | Chilton | 81/435 |
| 3,601,168 | | 8/1971 | Fernström . | |
| 3,623,646 | | 11/1971 | Reich et al. . | |

(List continued on next page.)

FOREIGN PATENT DOCUMENTS

| | | |
|---|---|---|
| 2750562 | 11/1977 | (DE) . |
| 0248101 | 6/1986 | (EP) . |
| 2132531 | 7/1984 | (GB) . |
| 2147873 | 5/1985 | (GB) . |

*Primary Examiner*—James G. Smith
*Assistant Examiner*—Anthony Ojini
(74) *Attorney, Agent, or Firm*—Maginot, Addison & Moore

(57) ABSTRACT

An apparatus for sequentially aligning a number of screws with a screwdriver and guiding the number of screws during advancement by the screwdriver is disclosed. The apparatus includes a body which includes (i) a channel adapted to receive a screw strip having the number of screws supported thereon, (ii) a feed passage adapted to sequentially receive the number of screws from the channel, and (ii) a guide track having a planar segment and an inclined ramp segment. The apparatus further includes a movable pawl which travels on the guide track through the planar segment and the inclined ramp segment, wherein (i) the movable pawl contacts at least one of the number of screws when both the movable pawl is located on the planar segment of the guide track and the screw strip having the number of screws supported thereon is located in the channel, and (ii) the movable pawl is spaced apart from all of the number of screws when both the movable pawl is located on the inclined ramp segment of the guide track and the screw strip having the number of screws supported thereon is located in the channel. Moreover, the movable pawl includes a spring and a slider assembly. The spring biases the slider assembly from the inclined ramp segment toward the planar segment.

22 Claims, 9 Drawing Sheets

U.S. PATENT DOCUMENTS

| | | | | |
|---|---|---|---|---|
| 3,885,669 | | 5/1975 | Potucek . | |
| 3,910,324 | | 10/1975 | Nasiatka . | |
| 3,930,297 | | 1/1976 | Potucek et al. . | |
| 4,018,254 | | 4/1977 | DeCaro . | |
| 4,062,388 | | 12/1977 | DeCaro . | |
| 4,146,071 | | 3/1979 | Mueller et al. . | |
| 4,167,229 | | 9/1979 | Keusch et al. . | |
| 4,367,837 | | 1/1983 | Manino . | |
| 4,428,261 | | 1/1984 | Takatsu et al. . | |
| 4,625,597 | | 12/1986 | Cast . | |
| 4,774,863 | * | 10/1988 | Geist | 81/435 X |
| 4,930,630 | | 6/1990 | Habermehl . | |
| 4,930,673 | | 6/1990 | Pfister . | |
| 5,027,679 | | 7/1991 | Kawashima et al. . | |
| 5,083,483 | | 1/1992 | Takagi . | |
| 5,092,460 | | 3/1992 | Satoh et al. . | |
| 5,101,697 | | 4/1992 | Fishback . | |
| 5,186,085 | | 2/1993 | Monacelli . | |
| 5,231,900 | | 8/1993 | Deri . | |
| 5,284,074 | | 2/1994 | Chen . | |
| 5,303,620 | | 4/1994 | Payne et al. . | |
| 5,337,635 | | 8/1994 | Habermehl . | |
| 5,337,636 | * | 8/1994 | Shea | 81/435 |
| 5,339,713 | | 8/1994 | Hou . | |
| 5,341,706 | | 8/1994 | Takagi . | |
| 5,351,586 | | 10/1994 | Habermehl et al. . | |
| 5,469,767 | | 11/1995 | Habermehl . | |
| 5,531,142 | | 7/1996 | Adamo . | |
| 5,531,143 | | 7/1996 | Habermehl et al. . | |
| 5,542,323 | | 8/1996 | Habermehl . | |
| 5,568,753 | | 10/1996 | Habermehl et al. . | |
| 5,570,618 | | 11/1996 | Habermehl et al. . | |
| 5,584,221 | | 12/1996 | Petrantoni . | |
| 5,622,024 | | 4/1997 | Habermehl . | |
| 5,660,090 | | 8/1997 | Deri . | |
| 5,662,011 | | 9/1997 | Habermehl . | |
| 5,699,704 | | 12/1997 | Habermehl . | |
| 5,706,708 | | 1/1998 | Refalo et al. . | |
| 5,758,768 | | 6/1998 | Habermehl et al. . | |

* cited by examiner

SCREW ALIGNING AND GUIDING DEVICE HAVING ARRANGEMENT WHICH FACILITATES LOADING AND UNLOADING OF SCREW STRIP

BACKGROUND OF THE INVENTION

The present invention relates generally to a screw aligning and guiding device, and more particularly to a screw aligning and guiding device having an arrangement which facilitates loading and unloading of a screw strip into and out of the device.

Numerous screw aligning and guiding devices have heretofore been designed which are adapted to be used with screw strips which have a number of screws supported thereon. The screw aligning and guiding devices are designed to sequentially feed screws into alignment with a bit end of a shaft driven by an electrically powered drill. The screw aligning and guiding devices are also designed to sequentially guide such screws during advancement thereof into a workpiece of such shaft.

In order to sequentially feed screws into alignment with the bit end of the shaft, the previously designed screw aligning and guiding devices have incorporated various pawl and ratchet mechanisms. Such mechanisms operate to engage one of the screws supported on an associated screw strip and urge the screw, and consequently the entire screw strip, upwardly toward a desired position. Typically, the previously designed screw aligning and guiding devices have utilized various springs to generate the biasing force needed to urge the screw strip upwardly.

The pawl and ratchet mechanisms, along with their associated springs, tend to be quite complex arrangements. Further, the interaction of the mechanical parts of the pawl and ratchet mechanism with the screws of the screw strip, make loading and unloading of the screw strip into and out of the device a somewhat difficult and complicated task.

What is needed therefore is a screw aligning and guiding device which overcomes one or more drawbacks of the previously designed devices. For example, what is needed is a screw aligning and guiding device which possesses a mechanism for urging a screw strip upwardly to a desired position in the device which is relatively less mechanically complex. Moreover, for example, what is needed is a screw aligning and guiding device which enables very easy loading and unloading of an associated screw strip into and out of the device.

SUMMARY OF THE INVENTION

In accordance with one embodiment of the present invention, there is provided an apparatus for sequentially aligning a number of screws with a screwdriver and guiding the number of screws during advancement by the screwdriver. The apparatus includes a body which includes (i) a channel adapted to receive a screw strip having the number of screws supported thereon, (ii) a feed passage adapted to sequentially receive the number of screws from the channel, and (ii) a guide track having a planar segment and an inclined ramp segment. The apparatus further includes a movable pawl which travels on the guide track through the planar segment and the inclined ramp segment, wherein (i) the movable pawl contacts at least one of the number of screws when both the movable pawl is located in the planar segment of the guide track and the screw strip having the number of screws supported thereon is located in the channel, and (ii) the movable pawl is spaced apart from all of the number of screws when both the movable pawl is located on the inclined ramp segment of the guide track and the screw strip having the number of screws supported thereon is located in the channel.

Pursuant to another embodiment of the present invention, there is provided a screw driver assembly which includes a shaft having a screw engaging end. The assembly further includes a body which includes (i) a channel adapted to receive a screw strip having a number of screws supported thereon, (ii) a feed passage adapted to sequentially receive the number of screws from the channel and guide the number of screws during advancement by the shaft, and (iii) a number of rails. Moreover, the assembly includes a movable pawl which travels on the number of rails, wherein (i) the movable pawl is positioned to contact at least one of the number of screws in the channel when both the movable pawl is located on a first portion of the number of rails and the screw strip having the number of screws supported thereon is located in the channel, and (ii) the movable pawl is spaced apart from all of the number of screws when both the movable pawl is located on a second portion of the number of rails and the screw strip having the number of screws supported thereon is located in the channel.

According to still another embodiment of the present invention, there is provided a screw aligning and guiding device. The device includes a body which includes (i) a channel adapted to receive a screw strip having a number of screws supported thereon, and (ii) a feed passage adapted to sequentially receive the number of screws from the channel and guide the number of screws during advancement by a screwdriver. The device further includes a movable pawl which is movable relative to the body, wherein (i) the movable pawl is positioned to contact at least one of the number of screws in the channel when both the movable pawl is located at a first orientation with respect to the body and the screw strip having the number of screws supported thereon is located in the channel, and (ii) the movable pawl is spaced apart from all of the number of screws when both the movable pawl is located at a second orientation with respect to the body and the screw strip having the number of screws supported thereon is located in the channel. The screw strip used in the device has an upper end and a lower end. And the movable pawl is located at a vertical position which is interposed between the upper end and the lower end when (i) the movable pawl is located at the second orientation with respect to the body, and (ii) the screw strip having the number of screws supported thereon is located in the channel.

It is therefore an object of the present invention to provide a new and useful screw aligning and guiding device.

It is another object of the present invention to provide an improved screw aligning and guiding device It is yet another object of the present invention to provide a screw aligning and guiding device which possesses a mechanism for urging a screw strip upwardly to a desired position in the device which is relatively less mechanically complex.

It is still another object of the present invention to provide a screw aligning and guiding device which enables very easy loading and unloading of an associated screw strip into and out of the device.

Other objects and benefits of the present invention can be discerned from the following description and accompanying drawings.

Figure 1:
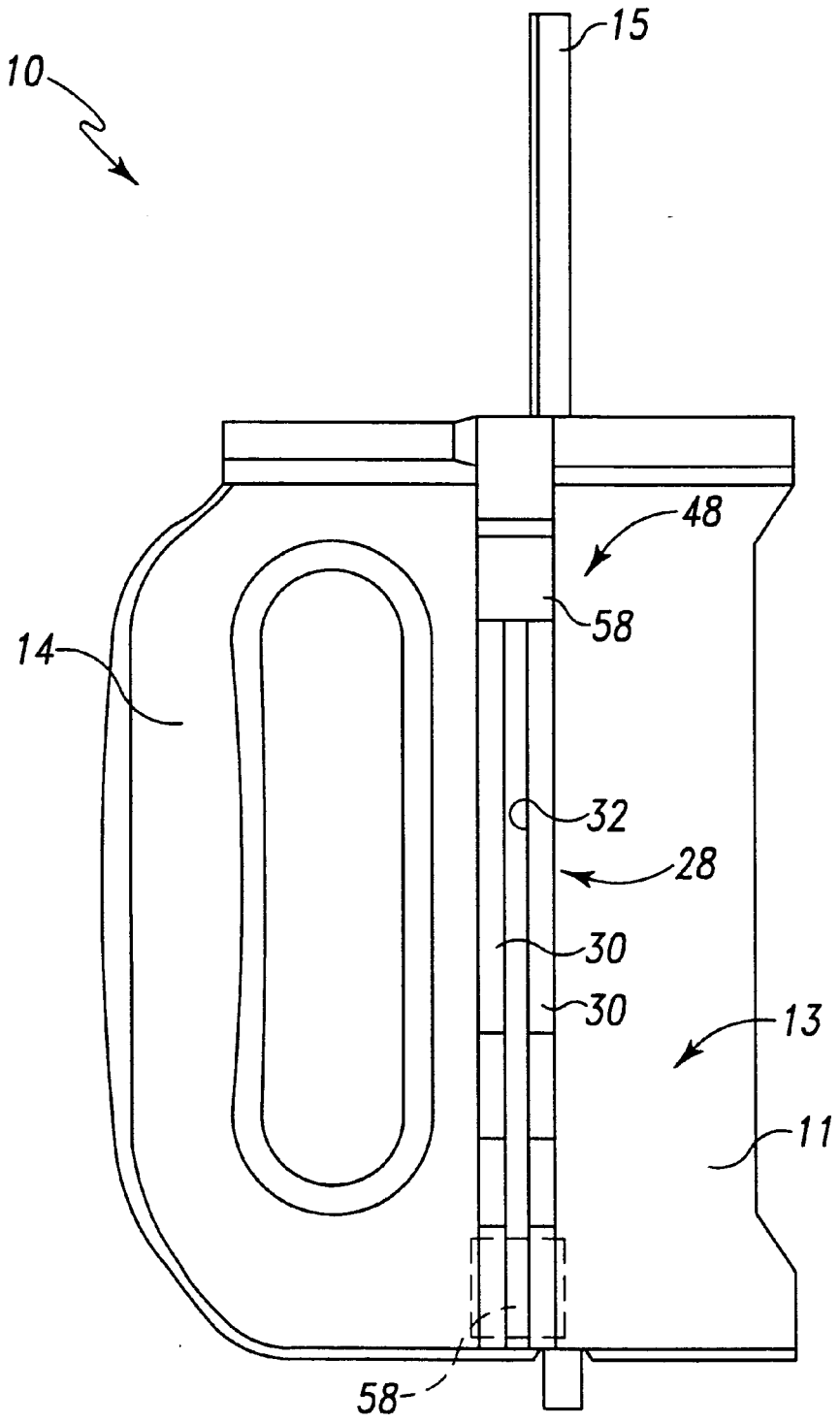
FIG. 1 is a left side elevational view of a screw aligning and guide device which incorporates the features of the present invention therein.
Figure 3:
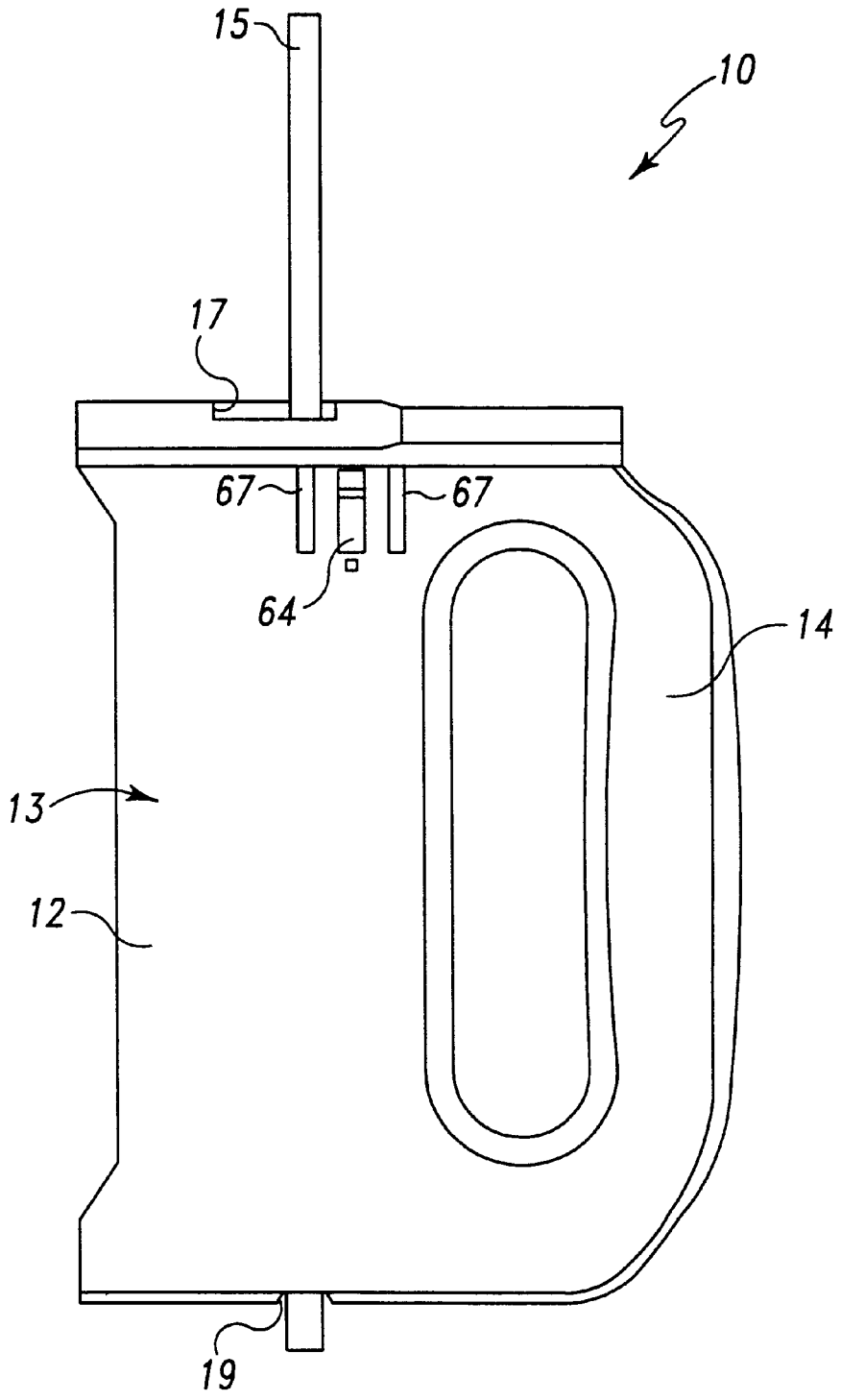
Figure 4:
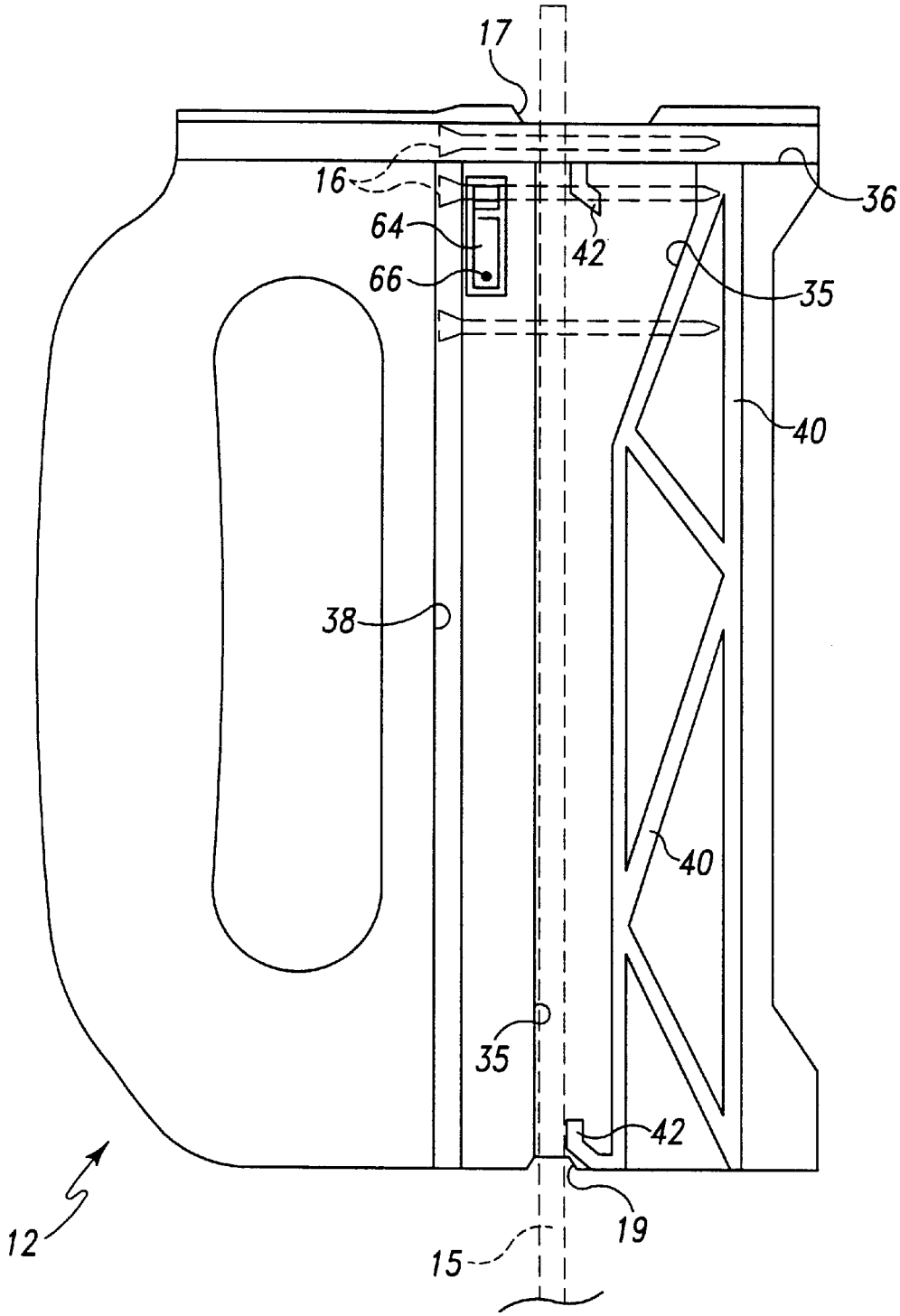
Figure 5:
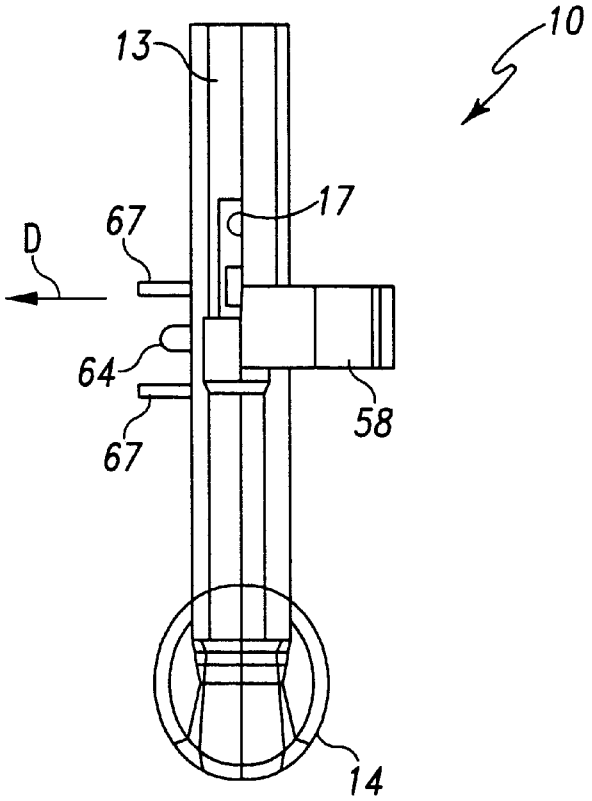
Figure 6:
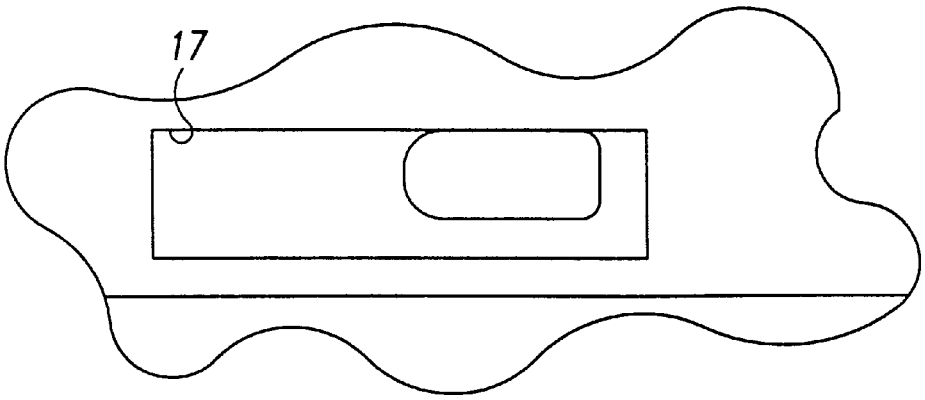
Figure 7:
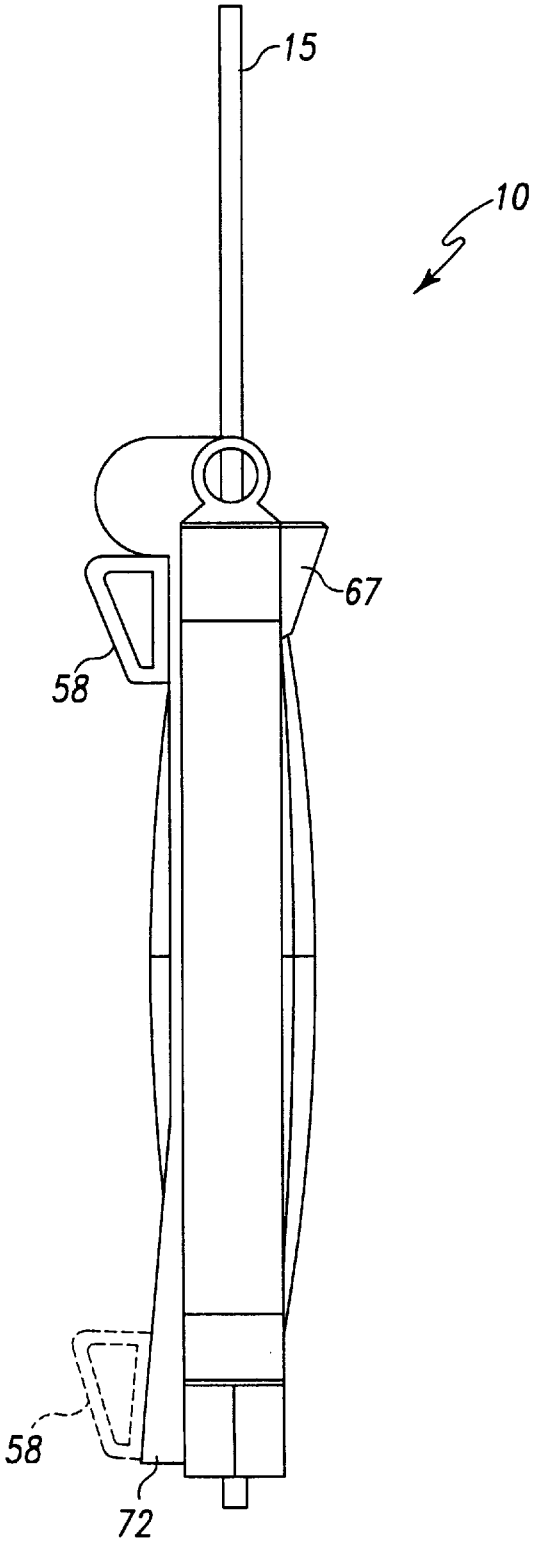
Figure 8:
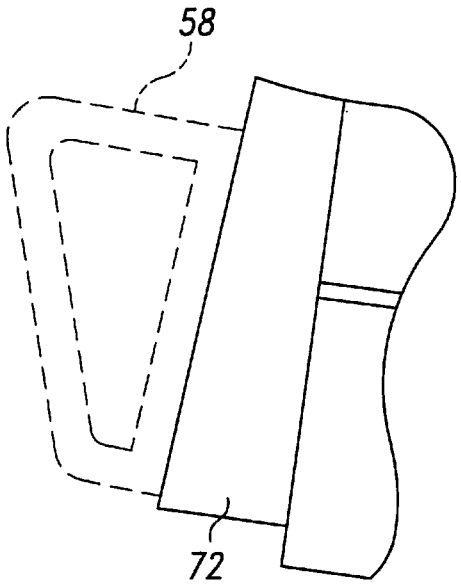
Figure 9:
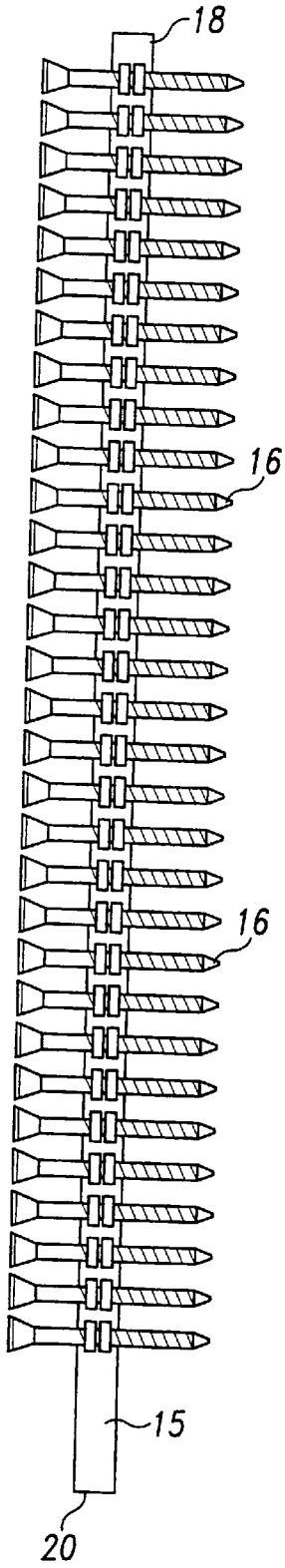
Figure 10:
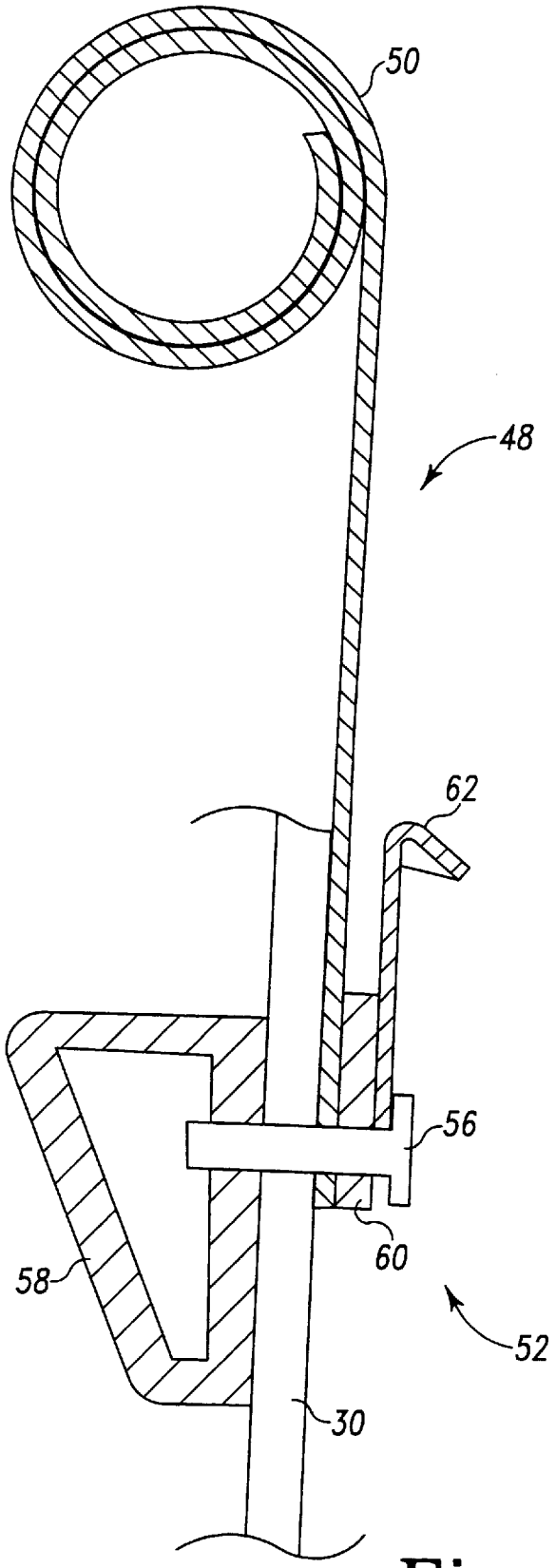
Figure 11:
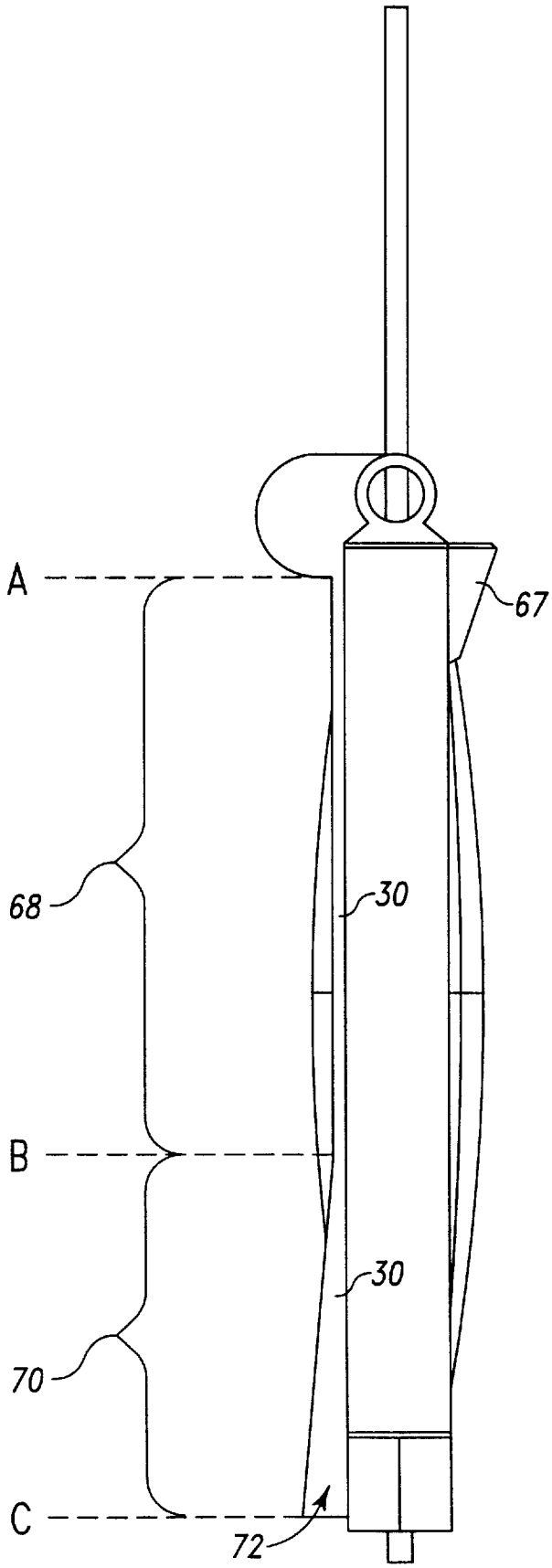

FIG, 2 is an enlarged side elevational view of a first housing portion of the screw aligning and guiding device of FIG. 1, with the first housing portion shown rotated 180° relative to its position depicted in FIG. 1 so as to show its internal structures and components thereof;

FIG. 3 is a right side elevational view of the screw aligning and guiding device of FIG. 1;

FIG. 4 is an enlarged side elevational view of a second housing portion of the screw aligning and guiding device of FIG. 1, with the second housing portion shown rotated 180° relative to its position depicted in FIG. 3 so as to show its internal structures and components thereof;

FIG. 5 is a top elevational view of the screw aligning and guiding device of FIG. 1;

FIG. 6 is an enlarged fragmentary view of the exit opening of the screw aligning and guiding device of FIG. 5;

FIG. 7 is a front elevational view of the screw aligning and guiding device of FIG. 1;

FIG. 8 is an enlarged fragmentary view of a lower portion of FIG. 7 showing the ramp member which is defined by the body of the screw aligning and guiding device;

FIG. 9 is an elevational view of a strip having a number of screws supported thereon which is used with the screw aligning and guiding device of FIG. 1;

FIG. 10 is a partial cross-sectional view of the movable pawl of the screw aligning and guiding device of FIG. 1 cooperating with one of the rails of the body; and FIG. 11 is an enlarged view of FIG. 7 but showing the handle of the movable pawl removed from the device for clarity of description.

DESCRIPTION OF THE PREFERRED EMBODIMENT

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
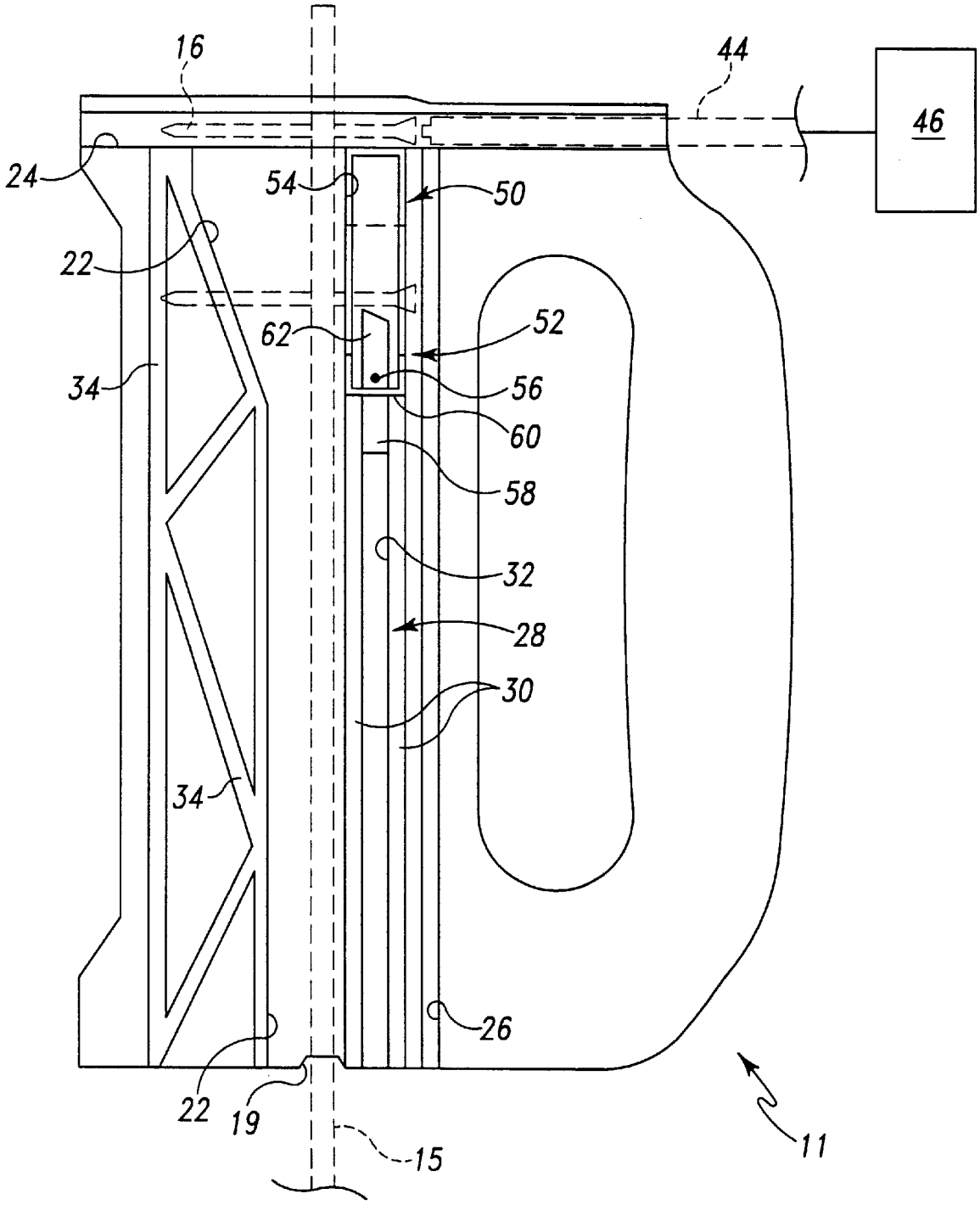

Referring now to FIGS. 1 and 3, there is shown a screw aligning and guiding device 10. The device includes a first housing portion 11 as shown in FIG. 2, and a second housing portion 12 as shown in FIG. 4. The first and second housing portions 11, 12 are preferably made from a 20% glass-filled nylon material, however, other types of thermoplastic materials may be used to make the housing portions 11, 12. The first housing portion 11 cooperates with the second housing portion 12 to form a body 13 having a handle 14 which enables a user to conveniently manipulate the device 10 during use thereof.

The device 10 is adapted to receive a screw strip 15 having a number of screws 16 supported thereon (see FIG. 9). The screw strip includes an upper end 18 and a lower end 20 as shown in FIG. 9. FIGS. 1 and 3 show the screw strip 15 and a number of screws 16 received within the device 10. Note that at certain times during operation of the device 10, an upper portion of the strip 15 extends out of an exit opening 17 defined in the top of the device 10, and a lower portion of the strip 15 extends out of an entrance opening 19 defined in the bottom of the device 10 as shown in FIGS. 1 and 3. The screws 16 may be any suitable type or possess any suitable size. For example, the screws 16 may be 2" yellow zinc coated screws. Alternatively, for example, the screws 16 may be 2" galvanized deck screws.

FIG. 2 shows the interior of the first housing portion 11. Note that FIG. 1 shows the exterior of the first housing portion 11. FIG. 2 shows the first housing portion rotated 180° relative to its position shown in FIG. 1 so as to expose internal structures and components thereof. The first housing portion 11 defines a channel portion 22, a feed passage portion 24, a screw head recess portion 26, and a guide track 28. The guide track 28 includes a pair of rails 30 which are spaced apart from each other so as to define a slider gap 32. The first housing portion 11 further includes a number of support ribs 34 positioned in a pattern to provide stability to the device 10.

FIG. 4 shows the interior of the second housing portion 12. Note that FIG. 3 shows the exterior of the second housing portion 12. FIG. 4 shows the second housing portion rotated 180° relative to its position shown in FIG. 3 so as to expose internal structures and components thereof. The second housing portion 12 defines a channel portion 35, a feed passage portion 36, and a screw head recess portion 38. The second housing portion 12 further includes a number of support ribs 40 positioned in a pattern to provide stability to the device 10.

The channel portion 22 and the channel portion 35 cooperate to define a strip and screw channel though which the screw strip 15 and the number of screws 16 supported thereon are advanced during operation of the device 10. The second housing portion 12 further includes a number of guide members 42 as shown in FIG. 4 which function to guide the screw strip 15 during advancement through the strip and screw channel.

The feed passage portion 24 and the feed passage portion 36 cooperate to define a feed passage adapted to sequentially receive screws 16 therein and guide the screws during advancement thereof by a shaft 44 having a bit end which is adapted to meshingly engage the head of a respective screw 16 (see FIG. 2). Note that the shaft 44 is driven by an electrically powered drill 46 as schematically shown in FIG. 2.

The screw head recess portion 26 and the screw head recess portion 38 cooperate to define a screw head recess which functions to allow vertical advancement of the screws 16 while preventing lateral advancement of the screws 16 (except for the uppermost screw on the screw strip 15) during operation of the device 10. Note that FIGS. 2 and 4 show a number of screws (in phantom) having their heads located in the screw head recess. Only selected screws 16 are shown supported by the screw strip 15 in FIGS. 2 and 4 for clarity of description. However, it should be noted that the screws 16 advancing though the device 10 would typically be supported on the screw strip 15 in a manner as shown in FIG. 9.

The device 10 further includes a movable pawl 48 which includes a spring 50 and a movable slider assembly 52. The spring 50 possesses a coil-shape in its relaxed, non-stressed state. During operation of the device 10, the spring 50 is located in a spring recess 54 which is defined by the first housing portion 11. An end portion of the spring 50 is secured to the slider assembly 52 by a fastener 56 which extends through the slider gap 32 as shown in FIG. 2 (see also FIG. 10). The spring 50 is preferably a stainless steel constant force spring. The spring 50 travels in sliding contact on the pair of rails 30 of the guide track 28 on the interior side of the housing portion 11 as shown in FIGS. 2 and 10.

The slider assembly 52 includes an external handle 58 which travels in sliding contact on the pair of rails 30 on the exterior side of the housing portion 11 as shown in FIG. 1. The slider assembly 52 further includes an internal plate 60 which is positioned in contact with the spring 50 as shown in FIG. 10. The slider assembly 52 further includes a finger 62 which is secured to both the external handle 58 and the internal plate 60 by the fastener 56. FIG. 10 shows a cross-sectional view of the components of the slider assembly 52 cooperating with one of the rails 30.

During operation of the device 10, the finger 62 is urged upwardly by the spring bias of the spring 50. As a result, the finger 62 contacts one of the screws 16 and urges such screw 16, and consequently, the entire screw strip 15 and all of the other screws 16 supported thereon upwardly until the uppermost screw 16 is positioned within the feed passage 24, 36 as shown in FIG. 2 Thereafter, the drill 46 is operated to rotate the uppermost screw 16. Rotation of the uppermost screw 16 causes such screw to separate from the screw strip 15 in a conventional manner. Then, advancement of shaft 44 causes advancement of such screw 16 whereby the structure of the device 10 which defines the feed passage 24, 36 guides the screw 16 during its advancement within the device 10. Thereafter, continued rotation of the screw 16 by the shaft 44 causes the screw 16 to be advanced into a workpiece such as a piece of wood.

After the uppermost screw 16 is advanced into the workpiece and the shaft 44 is retracted out of the feed passage 24, 36, the next uppermost screw 16 is advanced into the feed passage 24, 36 in a similar manner. Once the spring 50 retracts substantially completely into the spring recess 54 such that slider assembly 52 is moved to its uppermost position, the slide pawl must be cocked or otherwise manually pulled downwardly to again generate spring bias to urge the screw strip 15 and the screws 16 supported thereon in an upward direction.

In order to prevent the screw strip 15 and the associated screws 16 from being pulled downwardly while the movable pawl is being cocked downwardly, the device 10 further includes a stationary pawl 64, The stationary pawl 64 includes an end portion which extends into the strip and screw channel 22, 35 so that such end portion contacts one screw 16 supported on the strip 15 as the movable pawl is being cocked downwardly thereby preventing further downward travel of the screw strip 15 and the associated screws 16. FIG. 4 shows the screw 16 which is positioned next to the uppermost screw 16 contacting the stationary pawl 64.

The stationary pawl 64 is secured to the second housing portion 12 by a fastener 66. A pair of guards 67 are positioned adjacent to the stationary pawl 64 as shown in FIGS. 3 and 5 to provide protection to the stationary pawl 64 from inadvertent contact.

The guide track 28 includes a planar segment 68 and an inclined ramp segment 70 as shown in FIG. 11. In particular, the rails 30 extend for a first distance in a substantially planar manner from a point A to a point B. Then, the rails 30 extend in an inclined ramp-like manner from the point B to a point C. To this end, the first housing portion 11 includes a ramp member 72 defined therein as shown in FIG. 11.

When both the movable pawl 48 is located on the planar segment of the guide track 28 and the screw strip 15 having the number of screws 16 supported thereon is located in the strip and screw channel 22, 35, the movable pawl 48 contacts at least one of the number of screws 16 so as to urge the screw strip 15 and associated screws 16 upwardly. In particular, when both the movable pawl 48 is located on the planar segment of the guide track 28 and the screw strip 15 having the number of screws 16 supported thereon is located in the strip and screw channel 22, 35, the finger 62 of the movable pawl 48 is urged into contact with a lower side of a corresponding screw 16 as shown in FIG. 2 so as to urge the entire screw strip 15 and associated screws 16 upwardly.

After all of the screws 16 associated with one screw strip 15 are utilized, and it is desired to load a new screw strip 15 having associated screws 16 supported thereon into the device 10, a user grasps the handle 58 of the movable pawl 48 and urges it downwardly against the spring bias of the spring 50 from its actual position shown in solid lines in FIG. 1 to a loading position shown in phantom in FIG. 1. This action causes the slider assembly 52 to be advanced in sliding contact with the rails 30 to the loading position shown in phantom in FIG. 1. Now with the slider assembly 52 positioned in such loading position, the new screw strip 15 with its associated screws 16 is advanced upwardly into the strip and screw channel 22, 35 until its upper most screw is positioned in the feed passage 24, 36.

When the movable pawl 48 is located on the inclined ramp segment 70 of the guide track 28 and the screw strip 15 having the number of screws 16 supported thereon is located in the strip and screw channel 22, 35, the movable pawl 48 is spaced apart from all of the number of associated screws 16. In particular, when both the movable pawl 48 is located on the inclined ramp segment 70 of the guide track 28 and the screw strip 15 having the number of screws 16 supported thereon is located in the strip and screw channel 22, 35, the finger 62 of the movable pawl 48 is spaced apart from all of the number of associated screws 16. Moreover, when the movable pawl 48 is located at this orientation relative to the first housing portion 11, the movable pawl 48 (including its finger 62) is located at a vertical position which is interposed between the upper end 18 of the screw strip 15 and the lower end 20 of the screw strip 15.

Thereafter, once the new strip 15 and associated screws 16 are loaded into the strip and screw channel 22, 35, the movable pawl 48 is released thereby allowing the slider assembly 52 to be urged upwardly by the spring bias of spring 50 until the finger 52 contact one of the screws 16 to urge the entire strip 15 and its associated screws 16 upwardly.

If it is desired to remove a partially full screw strip from the device 10 (i.e. a screw strip 15 from which a number of screws have been removed, yet some are still remaining on the screw strip), the present invention facilitates such removal. In particular, in order to remove such partially full screw strip, the handle 58 is advanced onto the inclined ramp segment 70 to a location as shown in phantom in FIGS. 7 and 8. Thereafter, with the handle 58 located on the inclined ramp segment 70, the user grasps an end portion of the stationary pawl 64 which is extending out of the body 13 as shown in FIG. 5 and pulls the stationary pawl 64 in a direction indicated by arrow D. Pulling the stationary pawl 64 in such a direction moves the stationary pawl 64 out of the strip and screw channel 22, 35 so as to allow the strip 15 along with the associated screws 16 to be freely advanced downwardly out through the entrance opening 19 of the body 13.

While the invention has been illustrated and described in detail in the drawings and foregoing description, the same is to be considered as illustrative and not restrictive in character, it being understood that only the preferred embodiments and methods have been shown and described and that all changes and modifications that come within the spirit of the invention are desired to be protected.

There are a plurality of advantages of the present invention arising from the various features of the screw aligning and guiding device described herein. It will be noted that alternative embodiments of the screw aligning and guiding device of the present invention may not include all of the features described yet still benefit from at least some of the advantages of such features. Those of ordinary skill in the art may readily devise their own implementations of the screw aligning and guiding device that incorporate one or more of the features of the present invention and fall within the spirit and scope of the present invention as defined by the appended claims.

What is claimed is:

1. An apparatus for sequentially aligning a number of screws with a screwdriver and guiding said number of screws during advancement by said screwdriver, comprising:

a body which includes (i) a channel adapted to receive a screw strip having said number of screws supported thereon, (ii) a feed passage adapted to sequentially receive said number of screws from said channel, and (ii) a guide track having a planar segment and an inclined ramp segment; and a movable pawl which travels on said guide track through said planar segment and said inclined ramp segment, wherein (i) said movable pawl contacts at least one of said number of screws when both said movable pawl is located on said planar segment of said guide track and said screw strip having said number of screws supported thereon is located in said channel, and (ii) said movable pawl is spaced apart from all of said number of screws when both said movable pawl is located on said inclined ramp segment of said guide track and said screw strip having said number of screws supported thereon is located in said channel.

2. The apparatus of claim 1, wherein:

said movable pawl includes a spring and a slider assembly, and said spring biases said slider assembly from said inclined ramp segment toward said planar segment.

3. The apparatus of claim 2, wherein:

said body includes a spring recess, said spring is positioned within said spring recess, an end portion of said spring is secured to said slider assembly.

4. The apparatus of claim 3, wherein:

said guide track includes a pair of spaced apart rails defined by said body, said pair of spaced apart rails defines a slider gap, said slider assembly includes (i) an internal plate located on a first side of said rails, (ii) an external handle positioned on a second side of said rails, and (iii) a fastener which extends through said slider gap to secure said internal plate to said external handle, and (iv) a finger secured to said internal plate, and said finger contacts said at least one of said number of screws when both said movable pawl is located on said planar segment of said guide track and said screw strip having said number of screws supported thereon is located in said channel.

5. The apparatus of claim 4, wherein:

said finger is spaced apart from all of said number of screws when both said movable pawl is located on said inclined ramp segment of said guide track and said screw strip having said number of screws supported thereon is located in said channel.

6. The apparatus of claim 5, wherein:

said finger is spaced apart from said channel when said movable pawl is located on said inclined ramp segment of said guide track.

7. The apparatus of claim 4, wherein said pair of spaced apart rails defines said inclined ramp segment.

8. The apparatus of claim 1, further comprising a stationary pawl which is secured to said body and contacts another one of said number of screws when said movable pawl is moved from said planar segment to said inclined ramp segment.

9. A screw driver assembly, comprising:

a shaft having a screw engaging end;

a body which includes (i) a channel adapted to receive a screw strip having a number of screws supported thereon, (ii) a feed passage adapted to sequentially receive said number of screws from said channel and guide said number of screws during advancement by said shaft, and (iii) a number of rails; and a movable pawl which travels on said number of rails, wherein (i) said movable pawl is positioned to contact at least one of said number of screws in said channel when both said movable pawl is located on a first portion of said number of rails and said screw strip having said number of screws supported thereon is located in said channel, and (ii) said movable pawl is spaced apart from all of said number of screws when both said movable pawl is located on a second portion of said number of rails and said screw strip having said number of screws supported thereon is located in said channel.

10. The apparatus of claim 9, wherein:

said movable pawl includes a spring and a slider assembly, and said spring biases said slider assembly from said second portion of said number of rails toward said first portion of said number of rails.

11. The apparatus of claim 10, wherein:

said body includes a spring recess, said spring is positioned within said spring recess, an end portion of said spring is secured to said slider assembly.

12. The apparatus of claim 11, wherein:

said number of rails defines a slider gap, said slider assembly includes (i) an internal plate located on a first side of said number of rails, (ii) an external handle positioned on a second side of said number of rails, and (iii) a fastener which extends through said slider gap to secure said internal plate to said external handle, and (iv) a finger secured to said internal plate, and said finger contacts said at least one of said number of screws when both said movable pawl is located on said first portion of said number of rails and said screw strip having said number of screws supported thereon is located in said channel.

13. The apparatus of claim 12, wherein:

said finger is spaced apart from all of said number of screws when both said movable pawl is located on said second portion of said number of rails and said screw strip having said number of screws supported thereon is located in said channel.

14. The apparatus of claim 9, wherein:

said body further defines an inclined ramp member, and said inclined ramp member is defined by said second portion of said pair of spaced apart rails.

15. The apparatus of claim 9, further comprising a stationary pawl which is secured to said body and contacts another one of said number of screws when said movable pawl is moved from said first portion of said number of rails to said second portion of said number of rails.

16. A screw aligning and guiding device, comprising:

a body which includes (i) a channel adapted to receive a screw strip having a number of screws supported thereon, (ii) a feed passage adapted to sequentially receive said number of screws from said channel and guide said number of screws during advancement by a screwdriver, and (iii) a guide track; and a movable pawl which is movable relative to said body on said guide track, wherein (i) said movable pawl is positioned to contact at least one of said number of screws in said channel when both said movable pawl is located at a first location on said guide track and said screw strip having said number of screws supported thereon is located in said channel, and (ii) said movable pawl is spaced apart from all of said number of screws when both said movable pawl is located at a second location on said guide track and said screw strip having said number of screws supported thereon is located in said channel, wherein said first location on said guide track is spaced apart from said second location on said guide track, and wherein movement of said movable pawl from said first location on said guide track to said second location on said guide track causes said movable pawl to move in a direction away from said screw strip.

17. The apparatus of claim 16, wherein;

said movable pawl includes a spring and a slider assembly, and said spring biases said slider assembly from said second location on said guide track toward said first location on said guide track.

18. A screw aligning and guiding device, comprising:

a body which includes (i) a channel adapted to receive a screw strip having a number of screws supported thereon, and (ii) a feed passage adapted to sequentially receive said number of screws from said channel and guide said number of screws during advancement by a screwdriver; and a movable pawl which is movable relative to said body, wherein (i) said movable pawl is positioned to contact at least one of said number of screws in said channel when both said movable pawl is located at a first orientation with respect to said body and said screw strip having said number of screws supported thereon is located in said channel, and (ii) said movable pawl is spaced apart from all of said number of screws when both said movable pawl is located at a second orientation with respect to said body and said screw strip having said number of screws supported thereon is located in said channel, wherein said screw strip has an upper end and a lower end, and wherein said movable pawl is located at a vertical position which is interposed between said upper end and said lower end when (i) said movable pawl is located at said second orientation with respect to said body, and (ii) said screw strip having said number of screws supported thereon is located in said channel, wherein said movable pawl includes a spring and a slider assembly, wherein said spring biases said slider assembly from said second orientation to said first orientation, wherein said body includes a spring recess, wherein said spring is positioned within said spring recess, wherein an end portion of said spring is secured to said slider assembly.

19. The apparatus of claim 18, wherein:

said guide track includes a pair of spaced apart rails defined by said body, said pair of spaced apart rails defines a slider gap, said slider assembly includes (i) an internal plate located on a first side of said rails, (ii) an external handle positioned on a second side of said rails, and (iii) a fastener which extends through said slider gap to secure said internal plate to said external handle, and (iv) a finger secured to said internal plate, and said finger contacts said at least one of said number of screws when both said movable pawl is located at said first orientation and said screw strip having said number of screws supported thereon is located in said channel.

20. The apparatus of claim 19, wherein:

said finger is spaced apart from all of said number of screws when both said movable pawl is located at said second orientation and said screw strip having said number of screws supported thereon is located in said channel.

21. The apparatus of claim 19, wherein:

said body further defines an inclined ramp member, and said inclined ramp member is defined by at least a portion of said pair of spaced apart rails.

22. A screw aligning and guiding device, comprising:

a body which includes (i) a channel adapted to receive a screw strip having a number of screws supported thereon, and (ii) a feed passage adapted to sequentially receive said number of screws from said channel and guide said number of screws during advancement by a screwdriver; and a movable pawl which is movable relative to said body, wherein (i) said movable bawl is positioned to contact at least one of said number of screws in said channel when both said movable pawl is located at a first orientation with respect to said body and said screw strip having said number of screws supported thereon is located in said channel, and (ii) said movable pawl is spaced apart from all of said number of screws when both said movable pawl is located at a second orientation with respect to said body and said screw strip having said number of screws supported thereon is located in said channel, wherein said screw strip has an upper end and a lower end, and wherein said movable pawl is located at a vertical position which is interposed between said upper end and said lower end when (i) said movable pawl is located at said second orientation with respect to said body, and (ii) said screw strip having said number of screws supported thereon is located in said channel, and further comprising a stationary pawl which is secured to said body and contacts another one of said number of screws when said movable pawl is moved from said first orientation with respect to said body to said second orientation with respect to said body.

* * * * *